US007057509B2

(12) United States Patent
Gualdi et al.

(10) Patent No.: US 7,057,509 B2
(45) Date of Patent: Jun. 6, 2006

(54) MONITORING AN OBJECT WITH IDENTIFICATION DATA AND TRACKING DATA

(75) Inventors: Giovanni Gualdi, Palo Alto, CA (US); Cyril Brignone, Mountain View, CA (US); Salil Pradhan, San Jose, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 103 days.

(21) Appl. No.: 10/881,975

(22) Filed: Jun. 29, 2004

(65) Prior Publication Data

US 2005/0285733 A1 Dec. 29, 2005

(51) Int. Cl.
*G08B 1/08* (2006.01)

(52) U.S. Cl. ..... 340/539.13; 340/572.1; 340/568.1; 340/539.1; 340/5.1; 340/5.2; 340/933; 340/937

(58) Field of Classification Search ..... 340/572.1, 340/568.1, 5.1, 5.2, 539.1, 539.13, 933, 937
See application file for complete search history.

(56) References Cited

U.S. PATENT DOCUMENTS

| | | | | |
|---|---|---|---|---|
| 6,526,158 | B1 | 2/2003 | Goldberg | |
| 6,816,720 | B1 * | 11/2004 | Hussain et al. | 455/404.2 |
| 2004/0143602 | A1 * | 7/2004 | Ruiz et al. | 707/104.1 |
| 2005/0088320 | A1 * | 4/2005 | Kovach | 340/933 |

FOREIGN PATENT DOCUMENTS

| | | |
|---|---|---|
| EP | 1 578 130 | 9/2005 |
| WO | WO 01/46923 | 6/2001 |
| WO | WO 2004/051590 | 6/2004 |
| WO | WO 2004/051985 | 6/2004 |

* cited by examiner

*Primary Examiner*—Julie Bichngoc Lieu

(57) ABSTRACT

An object is monitored with identification data and tracking data. In an embodiment, a monitoring apparatus is utilized to monitor the object. The monitoring apparatus has a first interface for receiving identification data from an identification system. Moreover, the monitoring apparatus includes a second interface for receiving tracking data from a tracking system. Additionally, the monitoring apparatus further includes a merging unit for merging and storing the identification data and the tracking data of each monitored object to form monitoring data for each monitored object.

30 Claims, 11 Drawing Sheets

MONITORING AN OBJECT WITH IDENTIFICATION DATA AND TRACKING DATA

BACKGROUND OF THE INVENTION

1. Field of the Invention

The present invention generally relates to methods and systems for monitoring an object. More particularly, the present invention relates to monitoring an object with identification data and tracking data.

2. Related Art

In general, monitoring systems have been developed for specific applications. These monitoring systems attempt to let a user be aware of what is happening in the monitored environment and what objects are involved. Examples of objects include persons, vehicles, boxes, pallets, carts, and any other kind of object.

Typically, these monitoring systems focus on either identifying the objects or tracking what is happening in the monitored environment.

Monitoring systems that focus on identifying the objects can provide high accuracy in identifying the objects. However, these monitoring systems typically are deficient in several ways. First, the high accuracy in identifying objects is spatially limited. That is, the objects have to be within a particular distance of the identification sensors of the monitoring system to maintain the high accuracy. Beyond the particular distance, the accuracy can drop significantly. Secondly, since the focus is on identifying the objects, these monitoring systems typically lack or fail to provide sufficiently reliable tracking sensors to track the activity of the objects outside the scope of the identification sensors.

Alternatively, monitoring systems that focus on tracking what is happening in the monitored environment can track the activity of the objects in the monitored environment, where the monitored environment typically can be any desired size or shape. For example, the monitored environment can be small or large in size. Unfortunately, the accuracy of these monitoring systems typically decreases as the size of the monitored environment is increased. Moreover, these monitoring systems tend to assign tracking identifiers to each monitored object. These tracking identifiers usually are unrelated to the real identity of the monitored object.

A monitoring system capable of providing automated monitoring with the desired level of accuracy and flexibility is needed.

SUMMARY OF THE INVENTION

An object is monitored with identification data and tracking data. In an embodiment, a monitoring apparatus is utilized to monitor the object. The monitoring apparatus has a first interface for receiving identification data from an identification system. Moreover, the monitoring apparatus includes a second interface for receiving tracking data from a tracking system. Additionally, the monitoring apparatus further includes a merging unit for merging and storing the identification data and the tracking data of each monitored object to form monitoring data for each monitored object.

BRIEF DESCRIPTION OF THE DRAWINGS

The accompanying drawings, which are incorporated in and form a part of this specification, illustrate embodiments of the invention and, together with the description, serve to explain the principles of the present invention.

DETAILED DESCRIPTION OF THE INVENTION

Reference will now be made in detail to embodiments of the present invention, examples of which are illustrated in the accompanying drawings. While the invention will be described in conjunction with these embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention.

In an embodiment of the present invention, a monitoring system merges a tracking system and an identification system to obtain the desired level of accuracy and flexibility. Although the description will focus on non-invasive tracking systems, it should be understood that the present invention is equally applicable to invasive tracking systems. A non-invasive tracking system is configured to provide tracking functionality independently of the tracked object. For example, a tracking system that uses cameras as sensors to track the object is a type of non-invasive tracking system. An invasive tracking system is configured to provide tracking functionality dependent on something in the possession of the tracked object. For example, a tracking system that uses radio frequency transmitters coupled to the object and radio frequency sensors to track the object is a type of invasive tracking system.

Figure 1:
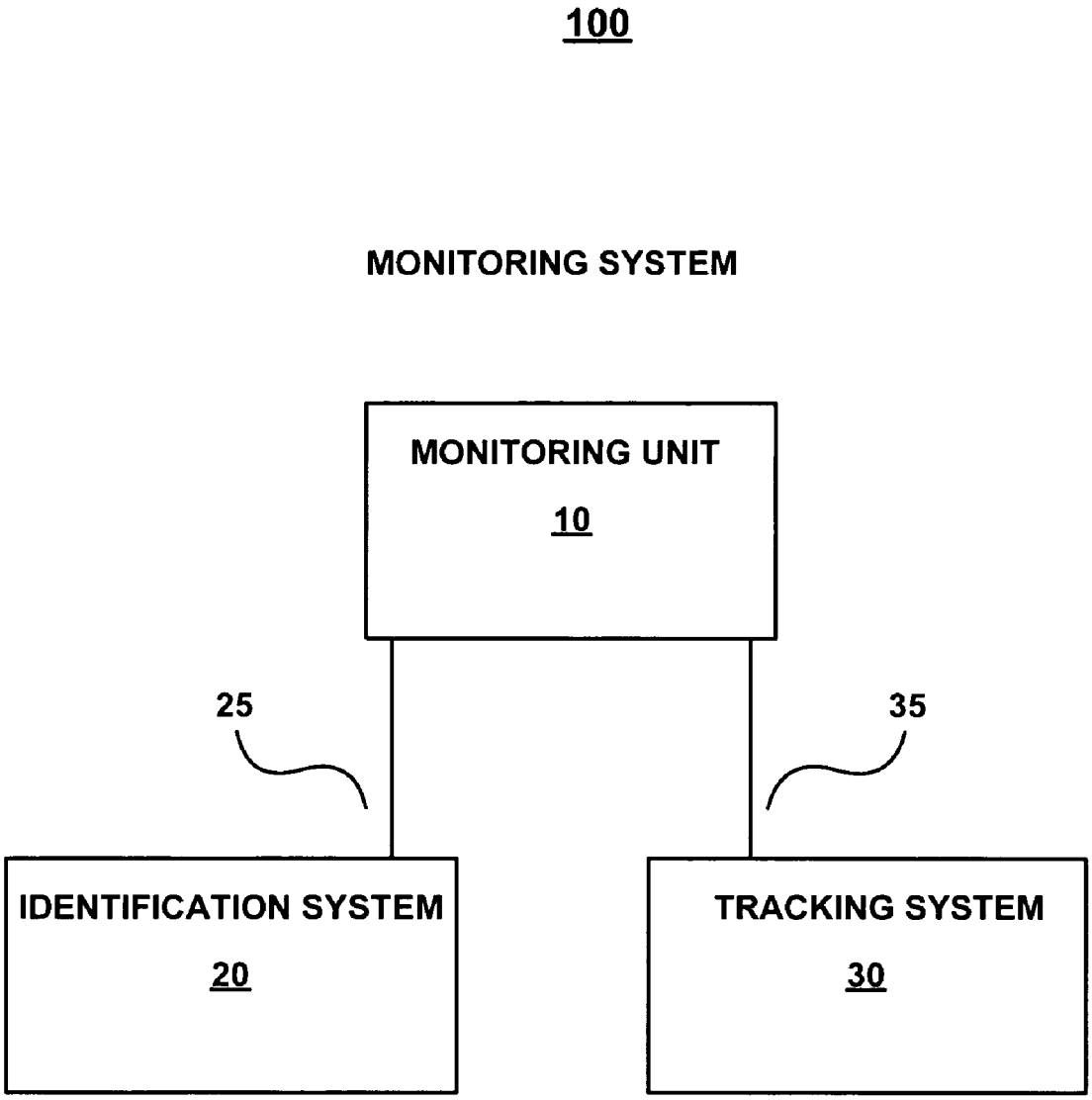
FIG. 1 illustrates a monitoring system in accordance with an embodiment of the present invention.

FIG. 1 illustrates a monitoring system 100 in accordance with an embodiment of the present invention. As depicted in FIG. 1, the monitoring system 100 includes a monitoring unit 10, an identification system 20, and a tracking system 30. The identification system 20 and the tracking system 30 are coupled to the monitoring unit 10 via connections 25 and 35, respectively. The monitoring system 100 allows users to be aware of what is happening in the monitored environment (or event) and who are the objects involved.

The monitoring system 100 merges tracking and identification functionalities from the identification system 20 and the tracking system 30 to exhibit several beneficial characteristics. The monitoring system 100 is able to monitor objects (e.g., persons, vehicles, boxes, pallets, carts, or any other kind of object) in a monitored environment that can range in size from small to large (e.g., room, aisle, floor, building, parking lot, etc.). Additionally, the monitoring system 100 is aware of the position of the object at desired time intervals via the tracking sensors of the tracking system 30. In an embodiment, the tracking system 30 uses non-invasive sensors, reducing the invasiveness of monitoring system 100 on the monitored environment. Moreover, monitoring system 100 is able to merge and store the identification data from the identification system 20 and the tracking data from the tracking system 30 for each monitored object to form monitoring data for each monitored object, enabling analysis and queries of this monitoring data.

The merging of tracking and identification functionalities makes the monitoring system 100 suitable for automated monitoring and non-automated monitoring applications. As will be described below, a level of accuracy in the tracking functionality suitable for automated monitoring applications is achieved by utilizing the accuracy of the identification functionality. Also, a desired level of detail in the description of the activity (or events) and the monitored objects involved is achieved by utilizing the tracking functionality and the identification functionality. For example, a person can be described by unique meaningless code, name, employee number, passport number, height, the shape of the iris, or any combination thereof. Moreover, the monitoring system 100 is sufficiently flexible to allow a variable level of human interaction and automatic functionality, as needed by the specific application.

Referring to FIG. 1, the tracking system 30 is able to determine/detect the presence of objects in the monitored environment. Moreover, the tracking system 30 associates a unique tracking identifier with the object. Furthermore, the tracking system 30 tracks the position of the object at desired time intervals to obtain a trajectory (e.g., in a coordinate system) for the object within the monitored environment. The unique tracking identifier distinguishes the objects. Maintaining the correct association between the unique tracking identifier and the object affects the accuracy of the tracking system 30. Also, the tracking system 30 can be several tracking subsystems that are functionally integrated or functionally independent of each other.

The accuracy of the tracking system 30 widely depends on the number, the type, and quality of the tracking sensors used. The tracking system 30 is not limited to any particular type of tracking sensor. In an embodiment, the tracking system 30 uses tracking sensors that are cameras, reducing the invasiveness of the monitoring system 100 on the monitored environment. Examples of cameras suitable for the tracking system 30 include color cameras, black-and-white cameras, infrared (IR) cameras, and range cameras. Cameras are considered non-invasive tracking sensors since the objects do not need to be equipped with anything specific to be tracked.

Generally, the tracking sensors provide a detailed level of description of the tracked objects. This description of the tracked object, the trajectory of the tracked object, and the unique tracking identifier are examples of tracking data generated by the tracking system 30. This tracking data is sent to the monitoring unit 10 and processed as described below.

Continuing with FIG. 1, the identification system 20 identifies the object by matching the object with one of the plurality of identities stored by the identification system 20. Generally, the level of accuracy of the identification system 20 is higher than the level of accuracy of the tracking system 30. This is possible because the identification system 20 is local. That is, the object is identified at a particular location. Moreover, the identification system 20 can be implemented as several identification subsystems that are functionally integrated or functionally independent of each other. Hence, the identification system 20 can utilize automated identification systems, human-assisted identification systems, or a combination of both. A typical human-assisted identification system is given by a police officer that checks the passport number from the people passing through a security point. An automatic identification system can be based on pattern recognition (e.g., face recognition, iris recognition, fingerprint recognition, voice recognition, etc.). As another example, the automatic identification system can be based on RFID (radio frequency identification) technology. This type of automatic identification system allows wireless recovery of the numeric code on an ID-tag equipped object, using a RFID reader.

Further, the identification system 20 can retrieve the identity of the object and gathers additional data about the objects. For example, if the object is a person, the weight, shape, size, and carried possessions can be described. This description of the identified object and the identity of the identified object are examples of identification data generated by the identification system 20. This identification data is sent to the monitoring unit 10 and processed as described below.

Typically, the design of the identification system 20 and of its identification sensors determines the type/quality/accuracy of identification and description obtained on the identified objects. For example, if the object is a person, face recognition using vision sensors provides a detailed description but lower identification accuracy compared to the RFID technology. Yet, both face recognition and RFID technology do not provide the information about the citizenship of the person that could be obtained with a passport check at a security point. Thus, the identification system 20 can be a combination of multi-sensor, multi-technology, and human-assisted systems of identification, making possible to reach the level of accuracy and description required by the application utilizing the monitoring system 100.

Referring to FIG. 1, the monitoring unit 10 receives the identification data from the identification system 20 and the tracking data from the tracking system 30. Moreover, the monitoring unit 10 merges and stores the identification data and the tracking data of each monitored object to form monitoring data for each monitored object. Before the identification data and the tracking data for each monitored object is merged, the monitoring system 100 interprets this data as representing tracking data for an object assigned the unique tracking identifier X and as identification data for an object identified as a person named John Smith. After the identification data and the tracking data for each monitored object is merged, the monitoring system 100 interprets this data as representing tracking data and identification data for a person named John Smith. In effect, the identification made by the identification system 20 replaces the unique tracking identifier assigned by the tracking system 30 from the perspective of the monitoring system 100.

Additionally, the monitoring unit 10 is configured to process the monitoring data (merged tracking data and identification data for each monitored object). Hence, the monitoring unit 10 can analyze and query the monitoring data, as needed.

Figure 2:
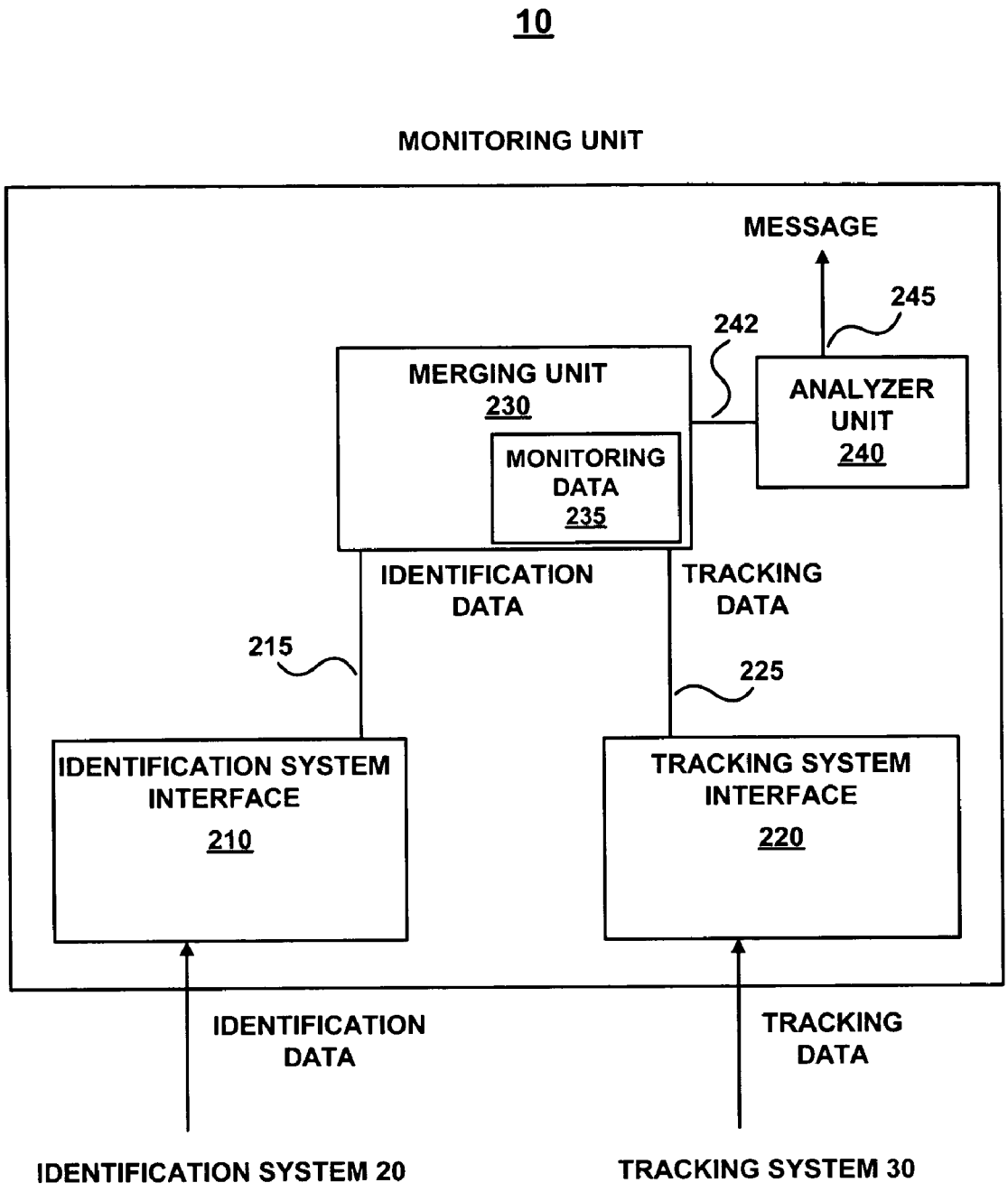
FIG. 2 illustrates a block diagram of the monitoring unit of FIG. 1 in accordance with an embodiment of the present invention.

FIG. 2 illustrates a block diagram of the monitoring unit 10 of FIG. 1 in accordance with an embodiment of the present invention. As depicted in FIG. 2, the monitoring unit 10 has an identification system interface 210 for receiving identification data from the identification system 20 (FIG. 1). Additionally, the monitoring unit 10 has a tracking system interface 220 for receiving tracking data from the tracking system 30 (FIG. 1). Furthermore, the monitoring unit 10 includes a merging unit 230 for merging and storing the identification data and the tracking data of each monitored object to form monitoring data 235 for each monitored object. The merging unit 230 includes the monitoring data 235. Also, the monitoring unit 10 has an analyzer unit 240 for processing the monitoring data 235. The components of the monitoring unit 10 can be implemented in hardware, software, or a combination of software and hardware. It should be understood that the monitoring unit 10 can be implemented differently than that shown in FIG. 2.

The merging unit is coupled to the identification system interface 210, the tracking system interface 220, and the analyzer unit 240 via connections 215, 225, and 242, respectively. Moreover, the analyzer unit 240 is configured to generate messages via line 245, as will be described below.

Figure 3:
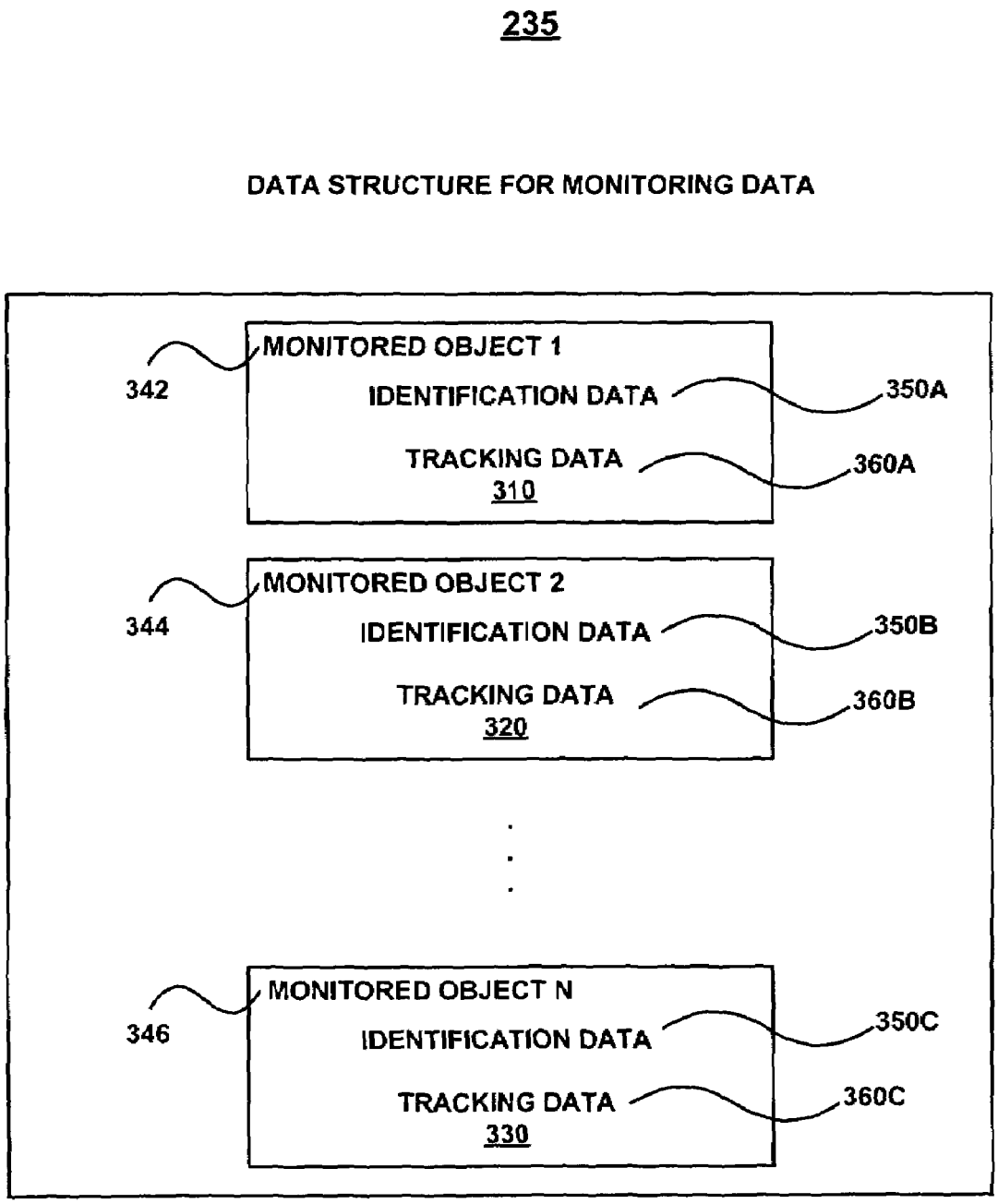
FIG. 3 illustrates data structure of monitoring data in accordance with an embodiment of the present invention.

FIG. 3 illustrates data structure of the monitoring data 235 in accordance with an embodiment of the present invention. In an embodiment, a computer-readable medium has stored therein the data structure of the monitoring data 235. Examples of a computer-readable medium include a magnetic disk, CD-ROM, an optical medium, a floppy disk, a flexible disk, a hard disk, a magnetic tape, a RAM, a ROM, a PROM, an EPROM, a flash-EPROM, or any other medium from which a computer can read.

As shown in FIG. 3, the data structure of the monitoring data 235 includes a plurality of monitoring data groups 310, 320, and 330. Each monitoring data group 310–330 is associated with one of a plurality of monitored objects 342, 344, and 346. Moreover, each monitoring data group 310–330 includes identification data 350A–350C associated with a monitored object 342, 344, and 346. The identification data 350A–350C is generated when the monitored object 342, 344, and 346 is located at an identification gateway (as will be described below in connection with FIGS. 4 and 5) of a monitored environment. The identification system 20 (FIG. 1) generates the identification data 350A–350C. Each monitoring data group 310–330 includes tracking data 360A–360C associated with the monitored object 342, 344, and 346. The tracking data 360A–360C is generated when the monitored object 342, 344, and 346 is located within the monitored environment. The tracking system 30 (FIG. 1) generates the tracking data 360A–360C.

The identification gateway (e.g., 520A and 520B of FIG. 5) represents a location where the monitored object 342, 344 and 346 interfaces with the identification system 20 (FIG. 1). As described above, the identification system 20 can utilize automated identification systems, human-assisted identification systems, or a combination of both. As an example, a police officer that checks the passport number at a security checkpoint of a monitored person can represent an identification gateway. As another example, location of identification sensors based on pattern recognition (e.g., face recognition, iris recognition, fingerprint recognition, voice recognition, etc.) or based on RFID (radio frequency identification) technology can also represent an identification gateway.

Moreover, since the monitored environment (e.g., 510 and 540 of FIG. 5) is (physically or logically) partitioned from a non-monitored environment, the identification gateways (or checkpoints) 520A and 520B can be utilized to determine whether monitored objects have entered or left the monitored environment 510 and 540. The monitored objects transition from the non-monitored environment to the monitored environment and vice versa via an identification gateway (e.g., 520A). Moreover, monitored objects transition from the monitored environment 510 to another monitored environment 540 and vice versa via an identification gateway (e.g., gateway 520B).

As described above, description of the identified object and the identity of the identified object are examples of identification data 350A–350C received from the identification system 20. Similarly, the description of the tracked object, the trajectory of the tracked object, and the unique tracking identifier are examples of tracking data 360A–360C received from the tracking system 30. In the monitoring data 235, the identified object and the tracked object are merged into the monitored object 342, 344, and 346

As will be described below, the monitoring data group 310–330 of each monitored object 342, 344, and 346 is enriched with information provided when the identification gateways (will be described below in connection with FIGS. 4 and 5) identify the monitored objects 342, 344, and 346. In an embodiment, new descriptive information is generated at the identification gateways each time the monitored object 342, 344, and 346 is identified at any identification gateway and becomes part of the identification data 350A–350C.

Moreover, the monitoring data group 310–330 of each monitored object 342, 344, and 346 is enriched when the tracking system 30 (FIG. 1) provides tracking data 360A–360C having trajectories of the monitored objects 342, 344, and 346, enabling determination of interactions between monitored objects 342, 344, and 346 by comparing the trajectories.

Figure 4:
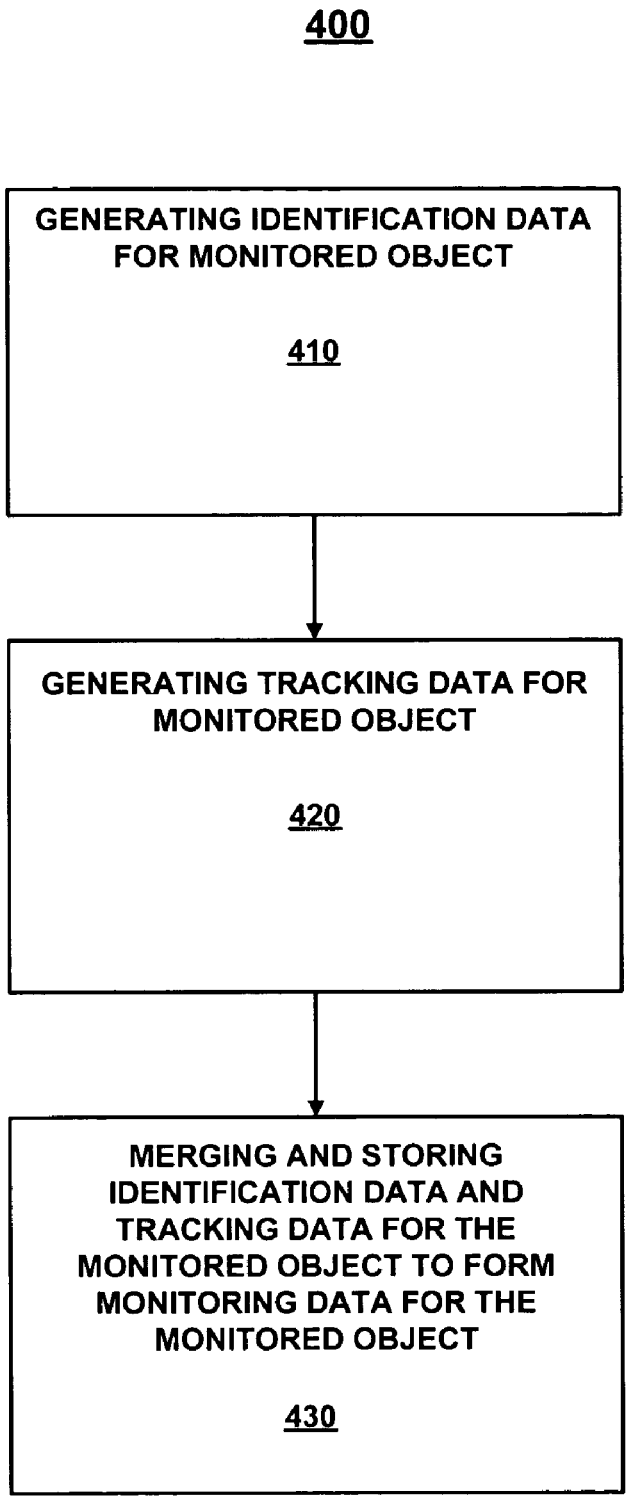
FIG. 4 illustrates a flow chart showing a method of monitoring an object in accordance with an embodiment of the present invention.
Figure 5:
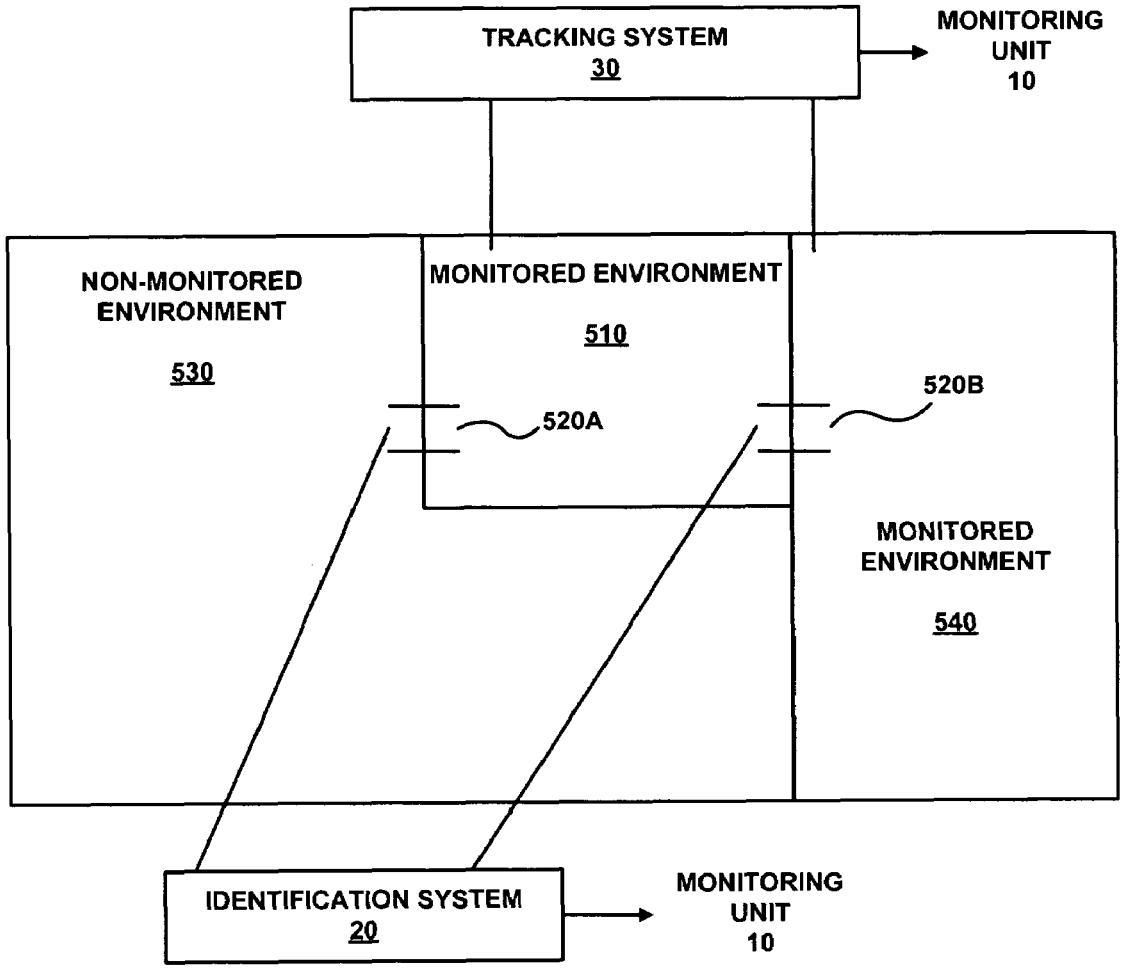
FIG. 5 illustrates operation of identification system and tracking system in accordance with an embodiment of the present invention.

FIG. 4 illustrates a flow chart showing a method 400 of monitoring an object in accordance with an embodiment of the present invention. Reference is made to FIGS. 1–3 and 5. In an embodiment, the method 400 is configured as computer-executable instructions stored in a computer-readable medium, such as a magnetic disk, CD-ROM, an optical medium, a floppy disk, a flexible disk, a hard disk, a magnetic tape, a RAM, a ROM, a PROM, an EPROM, a flash-EPROM, or any other medium from which a computer can read. FIG. 5 illustrates operation of identification system 20 and tracking system 30 in accordance with an embodiment of the present invention. As depicted in FIG. 5, the identification system 20 and the tracking system 30 are deployed to monitor an object(s) in a monitored environment 510. In particular, the monitored environment 510 is (physically or logically) partitioned from a non-monitored environment 530. The monitored environment 510 has one or more identification gateways (or checkpoints) 520A and 520B. In an embodiment, monitored objects transition from the non-monitored environment 530 to the monitored environment 510 and vice versa via an identification gateway (e.g., gateway 520A). Moreover, monitored objects transition from the monitored environment 510 to another monitored environment 540 and vice versa via an identification gateway (e.g., gateway 520B). The monitored environment 510 can have a wide range of sizes and shapes. Examples of monitored environments include a floor of a building (e.g., an airport, a warehouse, a data center, etc.), a building, a room, a portion of a room, an aisle, etc.

As shown in FIG. 5, the tracking system 30 tracks objects in each monitored environment 510 and 540. The tracking system 30 can be a single system or a collection of subsystems functionally integrated or functionally independent of one another. This flexibility allows implementation of different technologies for providing tracking functionality within the same monitored environment or in different monitored environments. For example, it is possible to implement infrared cameras in some monitored environments (e.g., where the face detection is essential) and to implement video cameras in other monitored environments (e.g., where moving carts should be tracked).

Continuing with FIG. 5, the identification system 20 is deployed such that when the monitored object is located at and transitions through any identification gateway 520A and 520B, the monitored object is identified by the identification system 20. In an embodiment, the identification system 20 can be implemented as several identification subsystems that are functionally integrated or functionally independent of each other. This flexibility allows implementation of different technologies for providing identification functionality within the same identification gateway or in different identification gateways.

Referring again to FIG. 4, at Step 410, identification data is generated, where the identification data is associated with each monitored object located at an identification gateway (e.g., gateway 520A or gateway 520B) of a monitored environment. The identification data is generated by an identification system 20 deployed such that when the monitored object is located at and transitions through any identification gateway 520A and 520B, the monitored object is identified by the identification system 20.

Continuing with Step 420, tracking data is generating, where the tracking data is associated with each monitored object located within the monitored environment 510 and 540. The tracking data is generated by the tracking system 30.

At Step 430, the identification data and the tracking data of each monitored object is merged and stored, forming the monitoring data for each monitored object. The monitoring data can be processed, as needed.

Figure 6:
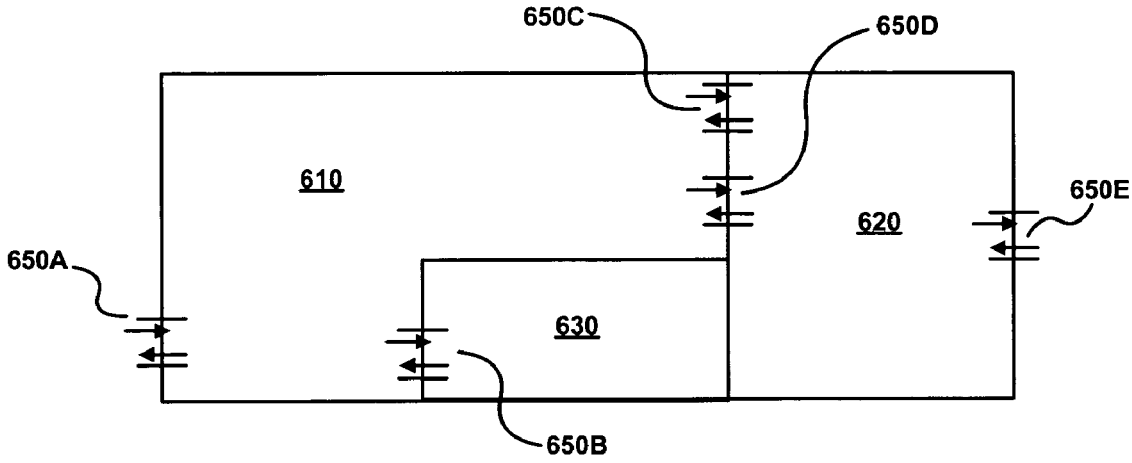
FIG. 6 illustrates monitored environments in accordance with an embodiment of the present invention.

FIG. 6 illustrates monitored environments in accordance with an embodiment of the present invention. As shown in FIG. 6, the tracking system (not shown) and the identification system (not shown) of the monitoring system 100 of FIG. 1 have been deployed to monitor objects in three separate monitored environments 610, 620, and 630. Moreover, the identification gateways 650A–650E are also depicted.

Figure 7:
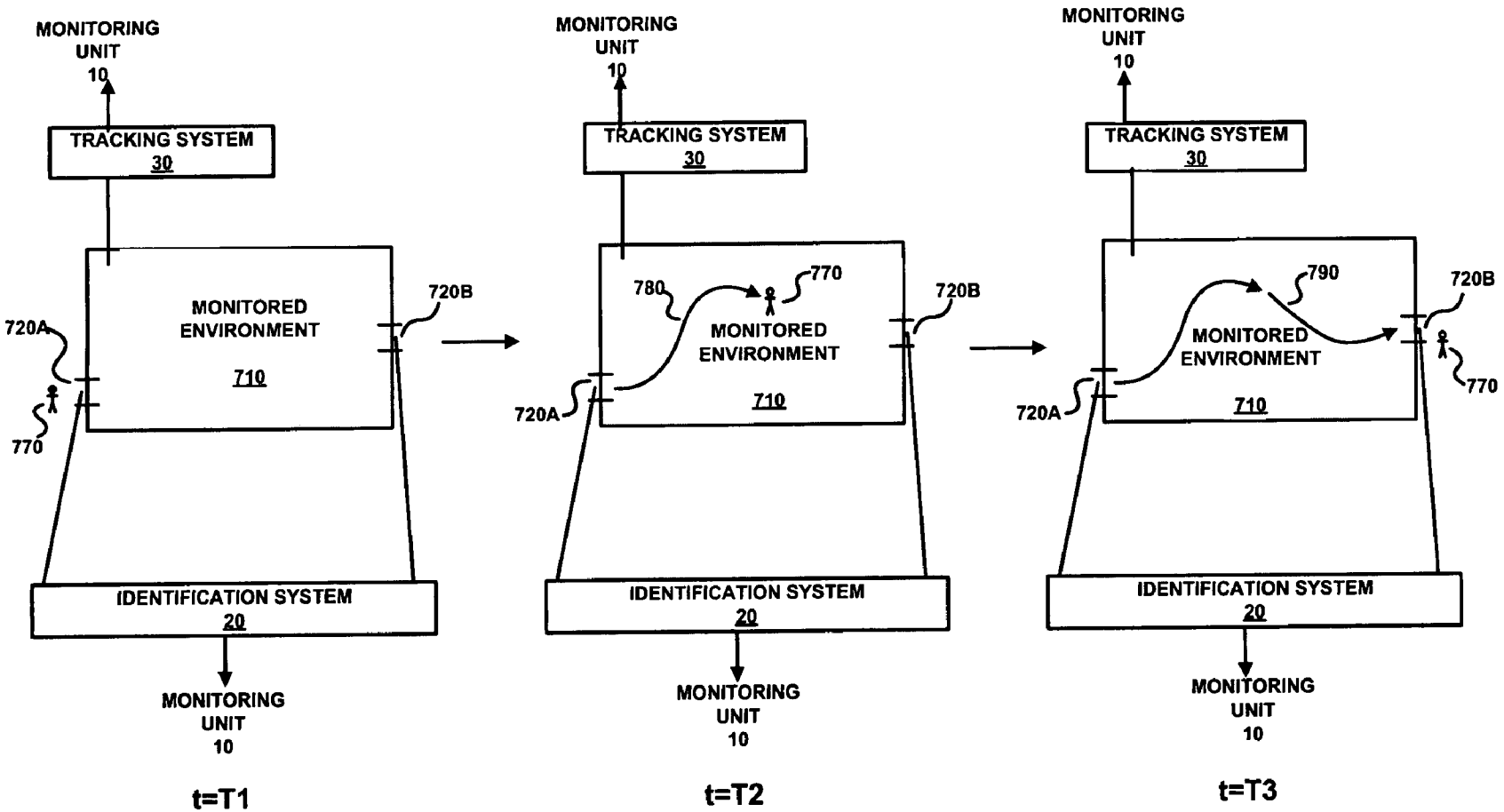
FIG. 7 illustrates operation of the monitoring system of FIG. 1 in accordance with an embodiment of the present invention.

Operation of the monitoring system of FIG. 1 in accordance with an embodiment of the present invention is illustrated in FIG. 7. The tracking system 30 tracks the monitored object 770 within the monitored environment 710. Moreover, the identification system 20 is deployed such that when the monitored object 770 is located at and transitions through any identification gateway 720A and 720B, the monitored object 770 is identified by the identification system 20.

At t=T1, the object 770 is located at identification gateway 720A. Thus, the identification system 20 identifies the object 770. Also, at t=T1, the tracking system 30 detects the object 770 and starts tracking the object 770. The monitoring unit 10 receives the identification data (e.g., the name John Smith, the passport number X, identification occurred at identification gateway 720A at t=T1, etc.) from the identification system 20. Similarly, the monitoring unit 10 receives the tracking data (e.g., object assigned unique tracking code Y is positioned at P1 at t=T1, where P1 represents the identification gateway 720A) from the tracking system 30. Since the identification data and the tracking data indicate object 770 is at identification gateway 720A (or position P1) at t=T1, the monitoring unit 10 determines that the received identification data and the tracking data should be merged since the position (as provided by the identification system 20 and the tracking system 30) is the same within the same time (as provided by the identification system 20 and the tracking system 30). Hence, the monitoring unit 10 merges the received identification data and the tracking data to form the monitoring data for monitored object 770. Moreover, if the monitored object 770 already is associated with a monitoring data group (as described in FIG. 3), the merged data is stored with the monitoring data group. Typically, the identification data enables the monitoring unit 10 to determine whether the monitored object 770 is associated with a monitoring data group. If the monitored object 770 is not associated with a monitoring data group, a monitoring data group is created for the monitored object 770 and the merged data is stored with the created monitoring data group.

At t=T2, the tracking system 30 continues to track the monitored object 770. The monitoring unit 10 receives the tracking data (e.g., object assigned unique tracking code Y is positioned at P2 at t=T2) from the tracking system 30. The monitoring unit 10 determines whether the unique tracking code Y has been assigned to any monitored object. Since monitored object 770 was assigned the unique tracking code Y by the tracking system 30, the monitoring unit 10 stores the tracking data with the monitoring data for monitored object 770. Since the monitored object 770 already is associated with a monitoring data group (as described in FIG. 3), the tracking data is stored with the monitoring data group. Moreover, the tracking data in the monitoring data group would indicate the monitored object 770 has the trajectory 780 in the monitored environment 710.

At t=T3, the monitored object 770 is located at identification gateway 720B. Thus, the identification system 20 identifies the monitored object 770. Moreover, the tracking system 30 continues to track the monitored object 770. The monitoring unit 10 receives the identification data (e.g., the name John Smith, the passport number X, identification occurred at identification gateway 720B at t=T3, etc.) from the identification system 20. Similarly, the monitoring unit 10 receives the tracking data (e.g., object assigned unique tracking code Y is positioned at P3 at t=T3, where P3 represents the identification gateway 720B) from the tracking system 30. Since the identification data and the tracking data indicate monitored object 770 is at identification gateway 720B (or position P3) at t=T3, the monitoring unit 10 determines that the received identification data and the tracking data should be merged since the position (as provided by the identification system 20 and the tracking system 30) is the same within the same time (as provided by the identification system 20 and the tracking system 30). Hence, the monitoring unit 10 merges the received identification data and the tracking data and stores it with the monitoring data of the monitored object 770. Since the monitored object 770 already is associated with a monitoring data group (as described in FIG. 3), the merged data is stored with the monitoring data group. Moreover, the tracking data in the monitoring data group would indicate the monitored object 770 has the trajectory 790 in the monitored environment 710.

If the identification gateway 720B provides a transition from the monitored environment 710 to a non-monitored environment, the monitored object 770 is no longer monitored by the monitoring system 100. However, if the identification gateway 720B provides a transition from the monitored environment 710 to another monitored environment, the tracking system 30 would continue to track the monitored object 770 in the other monitored environment.

The monitoring data 235 (FIGS. 2 and 3) can be analyzed to find the cause of a problem in a particular area within the monitored environment 710. For example, if the monitored environment 710 is an aisle in a warehouse or data center, an analysis of the monitoring data 235 can identify the monitored objects that were in the particular area within the monitored environment 710.

In addition to supporting identification functionality, each identification gateway provides the opportunity to compare the content of the monitoring data of a monitored object at different times. Additionally, each identification gateway provides the opportunity to recover from errors arising from the tracking system 30.

Figure 8:
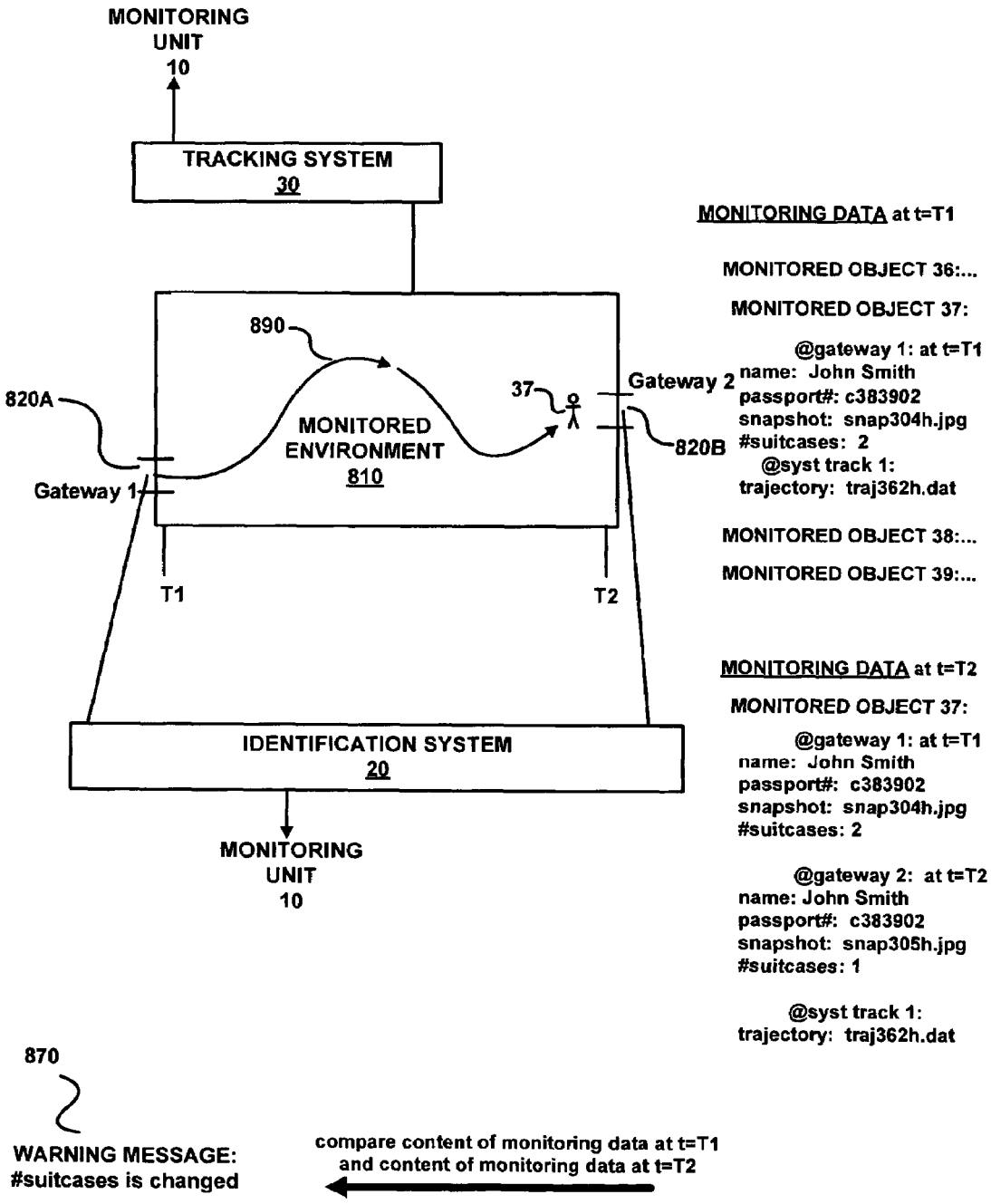
FIG. 8 illustrates comparison functionality of the monitoring system of FIG. 1 in accordance with an embodiment of the present invention.

FIG. 8 illustrates comparison functionality of the monitoring system 100 of FIG. 1 in accordance with an embodiment of the present invention. The tracking system 30 tracks the monitored object 37 within the monitored environment 810. Moreover, the identification system 20 is deployed such that when the monitored object 37 is located at and transitions through any identification gateway 820A and 820B, the monitored object 37 is identified by the identification system 20.

At t=T1, the monitored object 37 is located at identification gateway 820A (or Gateway1). Thus, the identification system 20 identifies the monitored object 37. Moreover, the tracking system 30 detects the monitored object 37 and starts tracking the monitored object 37. The monitoring unit 10 receives the identification data (e.g., the name John Smith, the passport number c383902, identification occurred at identification gateway 820A at t=T1, a snapshot, number of suitcases is 2, etc.) from the identification system 20. Similarly, the monitoring unit 10 receives the tracking data (e.g., object assigned unique tracking code Z is positioned at P1 at t=T1, where P1 represents the identification gateway 820A) from the tracking system 30. Since the identification data and the tracking data indicate monitored object 37 is at identification gateway 820A (or position P1) at t=T1, the monitoring unit 10 merges the received identification data and the tracking data and stores it with the monitoring data of the monitored object 37. Since the monitored object 37 already is associated with a monitoring data group (as described in FIG. 3), the merged data is stored with the monitoring data group.

At t=T2, the monitored object 37 is located at identification gateway 820B (or Gateway2). Thus, the identification system 20 identifies the monitored object 37. Moreover, the tracking system 30 continues to track the monitored object 770. The monitoring unit 10 receives the identification data (e.g., the name John Smith, the passport number c383902, identification occurred at identification gateway 820B at t=T1, a snapshot, the number of suitcases is 1, etc.) from the identification system 20. Similarly, the monitoring unit 10 receives the tracking data (e.g., object assigned unique tracking code Z is positioned at P2 at t=T2, where P2 represents the identification gateway 820B) from the tracking system 30. Since the identification data and the tracking data indicate monitored object 37 is at identification gateway 820B (or position P2) at t=T2, the monitoring unit 10 merges the received identification data and the tracking data and stores it with the monitoring data of the monitored object 37. Since the monitored object 37 already is associated with a monitoring data group (as described in FIG. 3), the merged data is stored with the monitoring data group. Moreover, the tracking data in the monitoring data group would indicate the monitored object 37 has the trajectory 890 in the monitored environment 810.

Since the monitored object 37 is identified at identification gateway 820B (or Gateway2) and identification data is generated, the monitoring unit 10 is able to compare the new content of the monitoring data (generated at identification gateway 820B) with the prior content of the monitoring data (generated at identification gateway 820A). In an embodiment, the analyzer unit 240 (FIG. 2) provides this functionality. The result of the comparison can lead to the generation of a warning message. For example, if there is a mismatch, a warning message 870 can be generated by the analyzer unit 240 via line 245 (FIG. 2). Under the facts of FIG. 8, "number of suitcases is changed" warning message 870 would be generated because the monitored object 37 had two suitcases at identification gateway 820A at t=T1 but had only one suitcase at identification gateway 820B at t=T2.

As discussed above, each identification gateway provides the opportunity to recover from errors arising from the tracking system 30. One type of error arising from the tracking system 30 is caused by losing track of a monitored object within the monitored environment. The identification data generated by identifying the monitored object at the identification gateway after losing track of the monitored object facilitates recovering from this type of error. This case will be illustrated in FIG. 9. Another type of error arising from the tracking system 30 is caused by interaction between monitored objects, reducing the tracking system's 30 level of certainty related to correct association between tracking data and the monitored objects. For example, two monitored objects may move to a location where they are near each other such that the tracking system 30 becomes confused and is unable to distinguish the two monitored objects. Then, the two objects separate. After the separation, the tracking system 30 will detect two monitored objects but will be unable to associate tracking data with the correct monitored object. The identification data generated by identifying a monitored object at the identification gateway after the tracking system 30 reduced the level of certainty facilitates recovering from this type of error. This case will be illustrated in FIGS. 10A and 10B.

Figure 9:
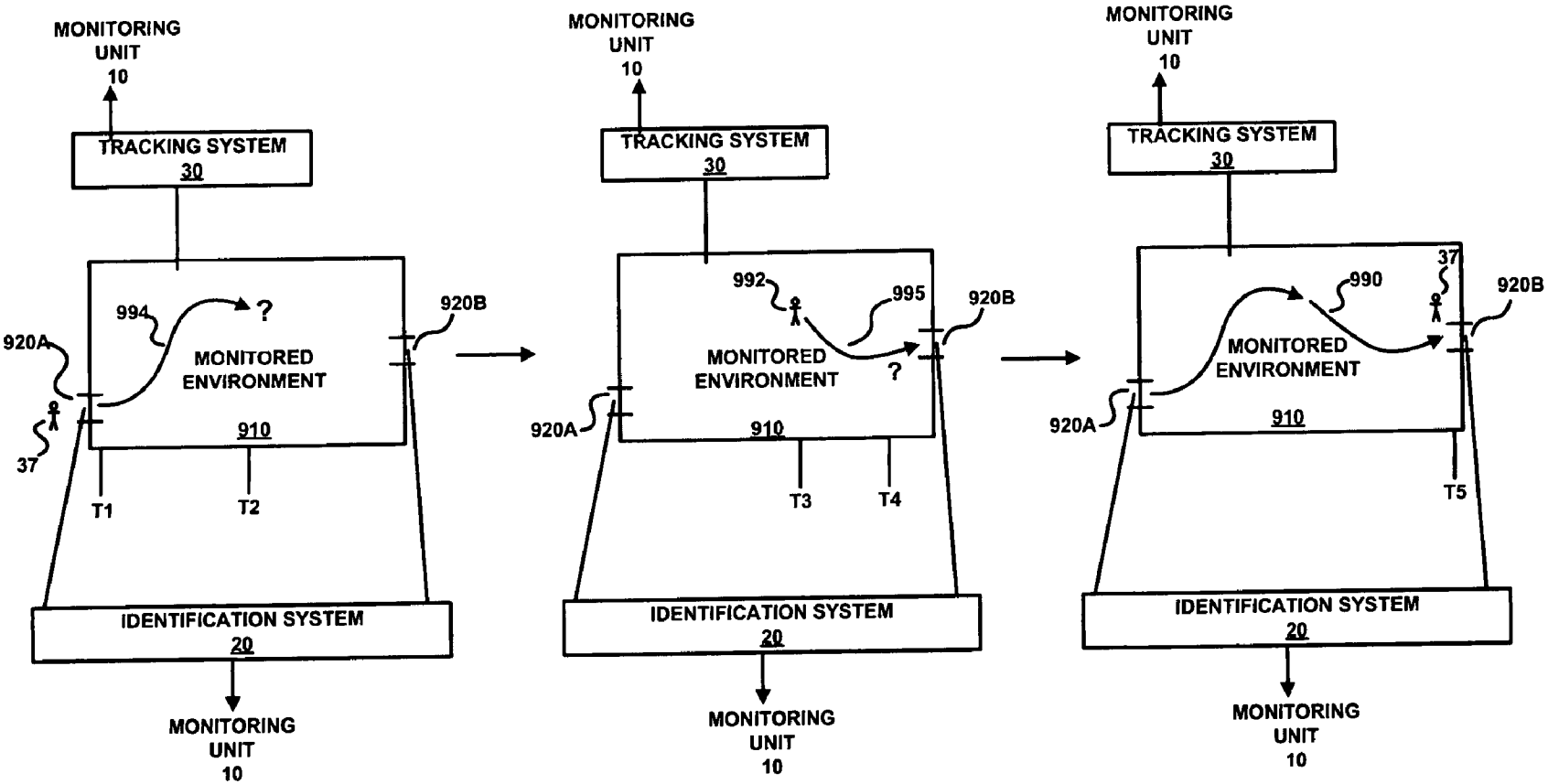
FIG. 9 illustrates a first error recovery functionality of the monitoring system of FIG. 1 in accordance with an embodiment of the present invention.

FIG. 9 illustrates a first error recovery functionality of the monitoring system 100 of FIG. 1 in accordance with an embodiment of the present invention. The tracking system 30 tracks the monitored object 37 within the monitored environment 910. Moreover, the identification system 20 is deployed such that when the monitored object 37 is located at and transitions through any identification gateway 920A and 920B, the monitored object 37 is identified by the identification system 20.

At t=T1, the monitored object 37 is located at identification gateway 920A. Thus, the identification system 20 identifies the monitored object 37. Moreover, the tracking system 30 detects the monitored object 37 and starts tracking the monitored object 37. The monitoring unit 10 receives the identification data (e.g., the name John Smith, identification occurred at identification gateway 920A at t=T1, etc.) from the identification system 20. Similarly, the monitoring unit 10 receives the tracking data (e.g., object assigned unique tracking code Z is positioned at P1 at t=T1, where P1 represents the identification gateway 920A) from the tracking system 30. Since the identification data and the tracking data indicate monitored object 37 is at identification gateway 920A (or position P1) at t=T1, the monitoring unit 10 determines that the received identification data and the tracking data should be merged since the position (as provided by the identification system 20 and the tracking system 30) is the same within the same time (as provided by the identification system 20 and the tracking system 30). Hence, the monitoring unit 10 merges the received identification data and the tracking data and stores it with the monitoring data of the monitored object 37. Since the monitored object 37 already is associated with a monitoring data group (as described in FIG. 3), the merged data is stored with the monitoring data group.

At t=T2, the tracking system 30 loses track of the monitored object 37. However, the tracking data in the monitoring data group would indicate the monitored object 37 has the trajectory 994 in the monitored environment 910 before loss of tracking. Later, at t=T3, the tracking system 30 detects an object 992. From the perspective of the tracking system 30, the assumption can be made that object 992 is monitored object 37 after considering time and position. However, if this assumption is incorrect, the monitoring unit 10 will incorrectly merge tracking data and identification data, raising the possibility that the ability to unwind the incorrectly merged data may be lost.

Thus, the tracking system 30 starts tracking the object 992, after assigning it the unique tracking code M. The monitoring unit 10 receives the tracking data (e.g., object assigned unique tracking code M is positioned at P3 at t=T3, etc.) from the tracking system 30. However, the monitoring unit 10 will determine that in the monitoring data 235 (FIGS. 2 and 3) none of the previously monitored objects has been assigned the unique tracking code M by the tracking system 30. Thus, the monitoring unit creates a monitoring data group for the monitored object 992 and stores the tracking data in the created monitoring data group. Furthermore, at t=T4, the tracking system 30 continues to track the monitored object 992. The monitoring unit 10 receives the tracking data (e.g., object assigned unique tracking code M is positioned at P4 at t=T4, etc.) from the tracking system 30. Since the monitored object 992 already is associated with a monitoring data group (as described in FIG. 3), the tracking data is stored with the monitoring data group. Moreover, the tracking data in the monitoring data group would indicate the monitored object 992 has the trajectory 995 in the monitored environment 910.

At t=T5, the monitored object 992 is located at identification gateway 920B. Thus, the identification system 20 identifies the monitored object 992 as being the monitored object 37. Moreover, the tracking system 30 continues to track the monitored object 992. The monitoring unit 10 receives the identification data (e.g., the name John Smith, identification occurred at identification gateway 920B at t=T5, etc.) from the identification system 20. Similarly, the monitoring unit 10 receives the tracking data (e.g., object assigned unique tracking code M is positioned at P5 at t=T5, where P5 represents the identification gateway 920B) from the tracking system 30. Since the identification data indicates that monitored object 992 is monitored object 37 and the tracking data indicates monitored object 992 is at identification gateway 920B (or position P5) at t=T5, the monitoring unit 10 merges the received identification data and the tracking data and stores it with the monitoring data of the monitored object 37. Since the monitored object 37 already is associated with a monitoring data group (as described in FIG. 3), the merged data is stored with the monitoring data group.

Additionally, the monitoring unit 10 modifies the monitoring data 235 (FIGS. 2 and 3) to merge the monitoring data group associated with monitored object 992 (which was assigned the tracking code M by the tracking system 30) and the monitoring data group associated with monitored object 37 (which was assigned the tracking code Z by the tracking system 30). Moreover, the tracking data in the monitoring data group would indicate the monitored object 37 has the trajectory 990 in the monitored environment 910. In an embodiment, the analyzer unit 240 (FIG. 2) provides this error recovery functionality that enables recovery from an error arising from the tracking system 30 caused by losing track of a monitored object within the monitored environment.

Figure 10A:
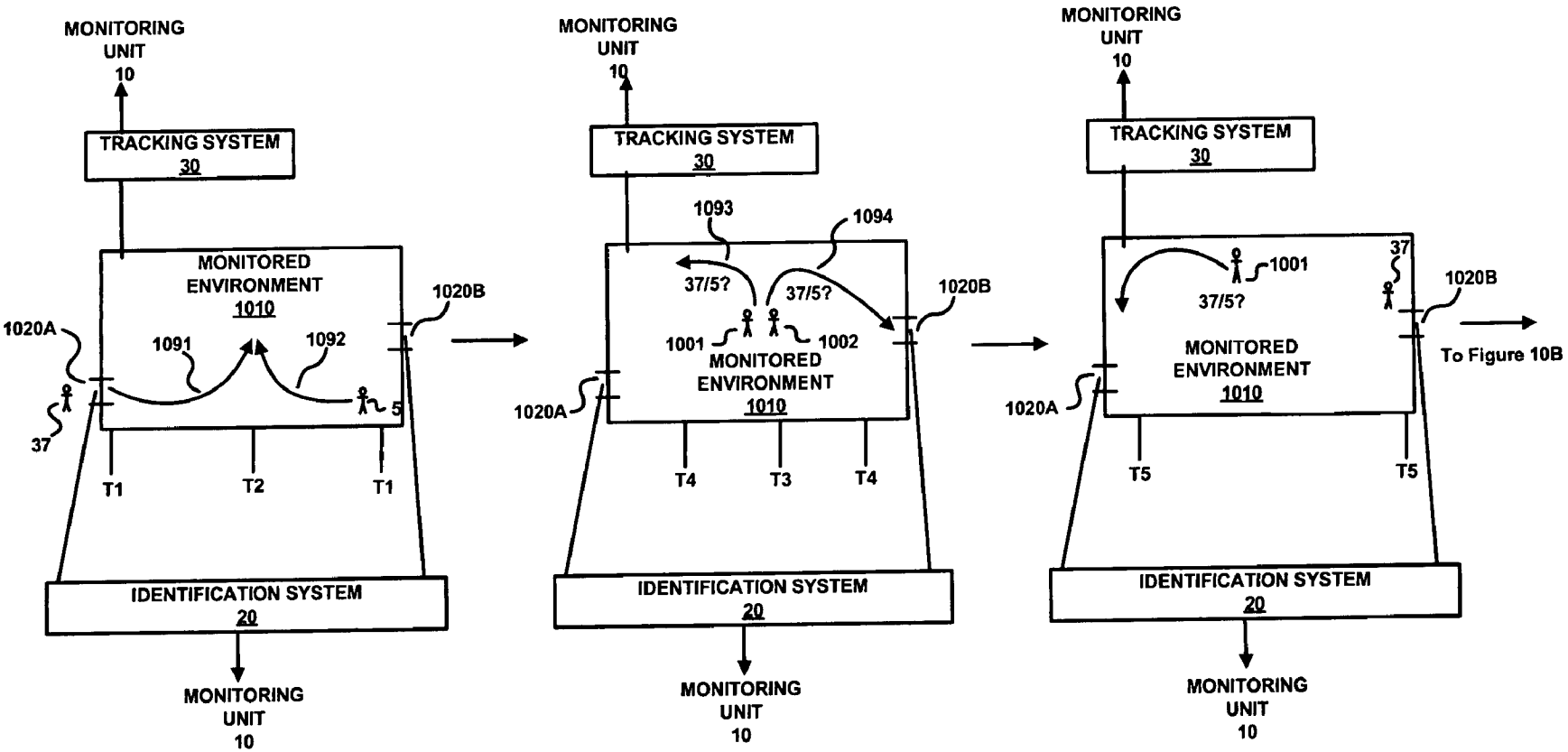
FIGS. 10A and 10B illustrate a second error recovery functionality of the monitoring system of FIG. 1 in accordance with an embodiment of the present invention.
Figure 10B:
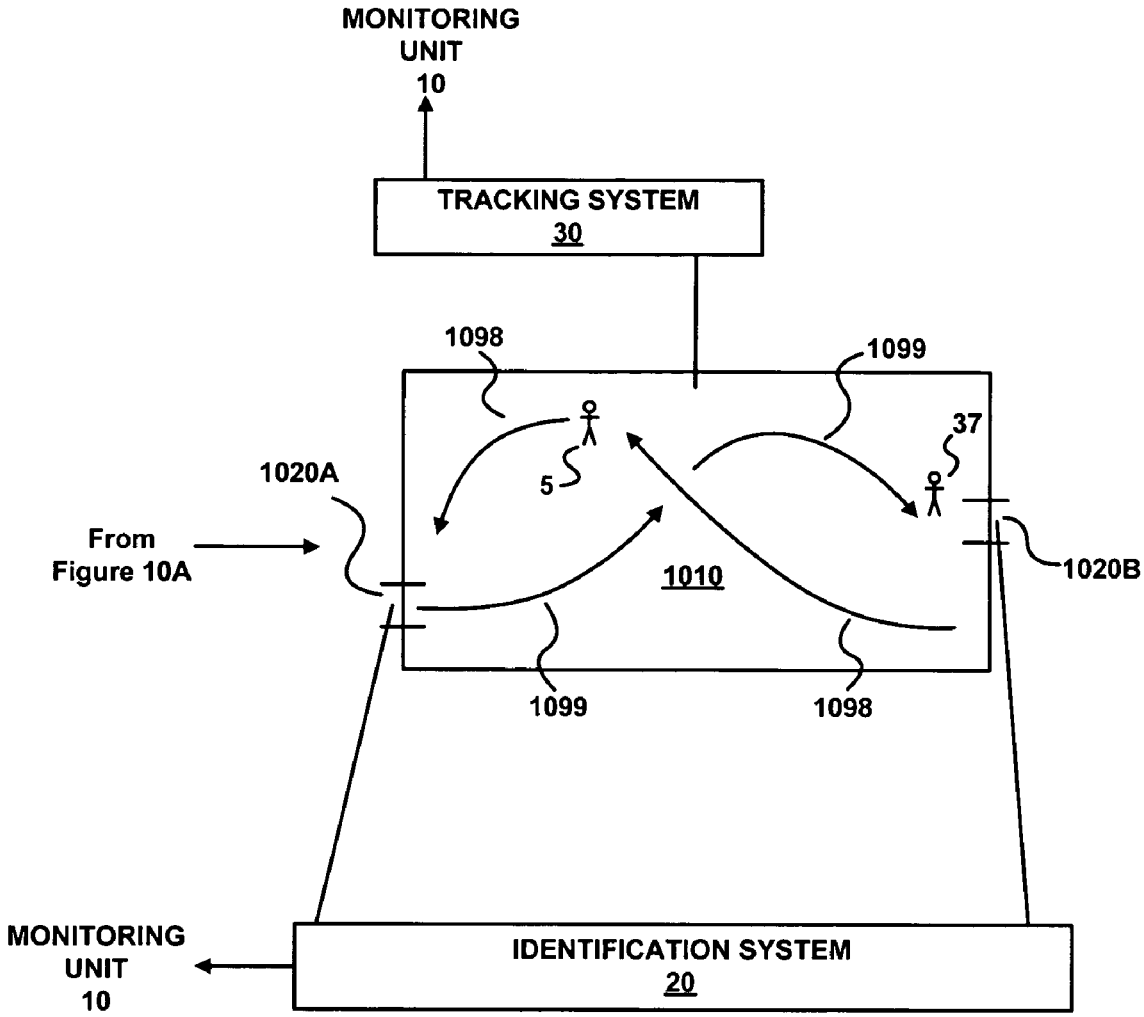

FIGS. 10A and 10B illustrate a second error recovery functionality of the monitoring system 100 of FIG. 1 in accordance with an embodiment of the present invention. As depicted in FIGS. 10A and 10B, the tracking system 30 tracks the monitored objects 37 and 5 within the monitored environment 1010. Moreover, the identification system 20 is deployed such that when the monitored object 37 or the monitored object 5 is located at and transitions through any identification gateway 1020A and 1020B, the monitored object 37 or 5 is identified by the identification system 20.

Referring to FIG. 10A, at t=T1, the tracking system 30 continues to track the monitored objects 37 and 5, which have previously transitioned through any identification gateway 1020A and 1020B for identification by the identification system 20. The tracking system 30 has assigned unique tracking code X to monitored object 37 and has assigned unique tracking code W to monitored object 5. Moreover, the tracking system 30 is 100% certain that it is associating the tracking data with the correct monitored object. The monitoring unit 10 receives the tracking data (e.g., object assigned unique tracking code X is positioned at P1A at t=T1, object assigned unique tracking code W is positioned at P1B at t=T1, etc.) from the tracking system 30. Since the monitored objects 37 and 5 already are associated with a corresponding monitoring data group (as described in FIG. 3), the tracking data for each monitored object 37 and 5 is stored with the corresponding monitoring data group.

At t=T2, the tracking system 30 continues to track the monitored objects 37 and 5. However, the monitored objects 37 and 5 move to a location where they are near each other such that the tracking system 30 becomes confused and is unable to distinguish the two monitored objects 37 and 5. Although the tracking system 30 is unable to distinguish the two monitored objects 37 and 5, the tracking system 30 determines that they are at positioned at P2 at t=T2. The monitoring unit 10 receives the tracking data (e.g., object assigned unique tracking code X is positioned at P2 at t=T2, object assigned unique tracking code W is positioned at P2 at t=T2, etc.) from the tracking system 30. Since the monitored objects 37 and 5 already are associated with a corresponding monitoring data group (as described in FIG. 3), the tracking data for each monitored object 37 and 5 is stored with the corresponding monitoring data group. Moreover, the tracking data in the corresponding monitoring data groups would indicate the monitored object 37 has the trajectory 1091 in the monitored environment 1010 while the monitored object 5 has the trajectory 1092 in the monitored environment 1010.

Continuing with FIG. 10A, at t=T3, the two monitored objects 37 and 5 have separated. After the separation, the tracking system 30 detects two monitored objects 1001 and 1002 but is unable to associate tracking data with the correct monitored object (e.g., monitored object 37 or monitored object 5) with 100% certainty. In fact, the tracking system is 50% certain that monitored object 1001 is monitored object 37 and is 50% certain that monitored object 1001 is monitored object 5. Similarly, the tracking system is 50% certain that monitored object 1002 is monitored object 37 and is 50% certain that monitored object 1002 is monitored object 5. Thus, the tracking system 30 has reduced the level of certainty related to correction association between tracking data and monitored objects. The monitoring unit 10 receives the tracking data (e.g., object assigned unique tracking code X or unique tracking code W is positioned at P3A at t=T3, object assigned unique tracking code W or unique tracking code X is positioned at P3B at t=T3, etc.) from the tracking system 30. Since the level of certainty related to correct association between tracking data and monitored objects is not 100%, the monitoring unit 10 stores this tracking data separately from the monitoring data groups associated with monitored object 37 and monitored object 5.

At t=T4, the tracking system 30 continues to track monitored objects 1001 and 1002. As discussed above, the tracking system is 50% certain that monitored object 1001 is monitored object 37 and is 50% certain that monitored object 1001 is monitored object 5. Similarly, the tracking system is 50% certain that monitored object 1002 is monitored object 37 and is 50% certain that monitored object 1002 is monitored object 5. The monitoring unit 10 receives the tracking data (e.g., object assigned unique tracking code X or unique tracking code W is positioned at P4A at t=T4, object assigned unique tracking code W or unique tracking code X is positioned at P4B at t=T4, etc.) from the tracking system 30. Since the level of certainty related to correct association between tracking data and monitored objects is not 100%, the monitoring unit 10 continues to store this tracking data separately from the monitoring data groups associated with monitored object 37 and monitored object 5. Moreover, the tracking data in the monitoring data group would indicate the monitored object 1001 has the trajectory 1093 in the monitored environment 1010 while the monitored object 1002 has the trajectory 1094 in the monitored environment 1010.

As depicted in FIG. 10A, at t=T5, the monitored object 1002 is located at identification gateway 1020B. Thus, the identification system 20 identifies the monitored object 1002 as being the monitored object 37. Moreover, the tracking system 30 continues to track the monitored object 37 and 1001. The monitoring unit 10 receives the identification data (e.g., the name John Smith, identification occurred at identification gateway 1020B at t=T5, etc.) from the identification system 20. Similarly, the monitoring unit 10 receives the tracking data (e.g., object assigned unique tracking code X or unique tracking code W is positioned at P5A at t=T5 where P5A represents the identification gateway 1020B, object assigned unique tracking code W or unique tracking code X is positioned at P5B at t=T5, etc.) from the tracking system 30. Since the identification data indicates that monitored object 1002 is monitored object 37 and the tracking data indicates monitored object 1002 is at identification gateway 1020B (or position P5A) at t=T5, the monitoring unit 10 merges the received identification data associated with monitored object 1002 and the tracking data associated with monitored object 1002 and stores it with the monitoring data of the monitored object 37. Since the monitored object 37 already is associated with a monitoring data group (as described in FIG. 3), the merged data is stored with the corresponding monitoring data group.

Referring to FIG. 10B, since the monitoring unit 10 is 100% certain that monitored object 1002 is monitored object 37 due to the identification system 20, the monitoring unit 10 can determine with 100% certainty that monitored object 1001 is monitored object 5. Thus, the monitoring unit 10 modifies the monitoring data 235 (FIGS. 2 and 3) to merge the monitoring data group associated with monitored object 1001 and the monitoring data group associated with monitored object 5. Furthermore, the monitoring unit 10 modifies the monitoring data 235 (FIGS. 2 and 3) to merge the monitoring data group associated with monitored object 1001 and the monitoring data group associated with monitored object 5. Therefore, the tracking data in the monitoring data groups would indicate the monitored object 37 has the trajectory 1099 in the monitored environment 1010 while the monitored object 5 has the trajectory 1098 in the monitored environment 1010. In an embodiment, the analyzer unit 240 (FIG. 2) provides this error recovery functionality that enables recovery from an error arising from the tracking system 30 caused by confusion and inability to distinguish monitored objects that are near each other.

In an embodiment, the invention is configured as computer-executable instructions stored in a computer-readable medium, such as a magnetic disk, CD-ROM, an optical medium, a floppy disk, a flexible disk, a hard disk, a magnetic tape, a RAM, a ROM, a PROM, an EPROM, a flash-EPROM, or any other medium from which a computer can read.

The foregoing descriptions of specific embodiments of the present invention have been presented for purposes of illustration and description. They are not intended to be exhaustive or to limit the invention to the precise forms disclosed, and many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A monitoring apparatus comprising:

a first interface for receiving identification data from an identification system;

a second interface for receiving tracking data from a tracking system;

a merging unit for merging and storing said identification data and said tracking data of each monitored object to form monitoring data for each monitored object; and an analyzer unit for processing said monitoring data, wherein said analyzer unit facilitates comparing new content of said monitoring data of a monitored object with prior content of said monitoring data of said monitored object.

2. The monitoring apparatus as recited in claim 1 wherein said analyzer unit generates a message based on a result of said comparison of said new and said prior content.

3. The monitoring apparatus as recited in claim 1 wherein if said tracking system loses track of a first monitored object within a monitored environment, said analyzer unit determines whether a second monitored object represents said first monitored object lost by said tracking system.

4. The monitoring apparatus as recited in claim 3 wherein said analyzer unit makes said determination in response to said identification system identifying said first monitored object after said tracking system lost track of said first monitored object, and wherein said analyzer unit modifies said monitoring data based on said determination.

5. The monitoring apparatus as recited in claim 1 wherein if said tracking system tracks a plurality of monitored objects within a monitored environment and if said tracking system reduces certainty related to correct association between tracking data and said monitored objects, said analyzer unit increases said certainty in response to said identification system identifying at least one of said monitored objects after said tracking system reduced said certainty.

6. The monitoring apparatus as recited in claim 5 wherein said analyzer unit modifies said monitoring data upon increasing said certainty.

7. A monitoring system comprising:

an identification system for generating identification data associated with each monitored object located at an identification gateway of a monitored environment;

a tracking system for generating tracking data associated with each monitored object located within said monitored environment; and a monitoring unit coupled to said identification and tracking systems, wherein said monitoring unit merges and stores said identification data and said tracking data of each monitored object to form monitoring data for each monitored object, wherein said monitoring unit compares new content of said monitoring data of a monitored object with prior content of said monitoring data of said monitored object.

8. The monitoring system as recited in claim 7 wherein said monitoring unit processes said monitoring data.

9. The monitoring system as recited in claim 7 wherein said monitoring unit generates a message based on a result of said comparison of said new and said prior content.

10. The monitoring system as recited in claim 8 wherein if said tracking system loses track of a first monitored object within said monitored environment, said monitoring unit determines whether a second monitored object represents said first monitored object lost by said tracking system.

11. The monitoring system as recited in claim 10 wherein said monitoring unit makes said determination in response to said identification system identifying said first monitored object after said tracking system lost track of said first monitored object, and wherein said monitoring unit modifies said monitoring data based on said determination.

12. The monitoring system as recited in claim 8 wherein if said tracking system tracks a plurality of monitored objects within said monitored environment and if said tracking system reduces certainty related to correct association between tracking data and said monitored objects, said monitoring unit increases said certainty in response to said identification system identifying at least one of said monitored objects after said tracking system reduced said certainty.

13. The monitoring system as recited in claim 12 wherein said monitoring unit modifies said monitoring data upon increasing said certainty.

14. A computer-readable medium having stored therein a data structure compnsing:

A plurality of monitoring data groups, each monitoring data group associated with one of a plurality of monitored objects, wherein each monitoring data group includes:

identification data associated with a monitored object, wherein said identification data is generated when said monitored object is located at an identification gateway of a monitored environment;

tracking data associated with said monitored object, wherein said tracking data is generated when said monitored object is located within said monitored environment; and merged data that is based on the comparison of new content of monitoring data of a monitored object and prior content of said monitoring data of said monitored object.

15. The computer-readable medium as recited in claim 14 wherein said identification data is generated by an identification system.

16. The computer-readable medium as recited in claim 14 wherein said tracking data is generated by a tracking system.

17. A method of monitoring an object, said method comprising:

generating identification data associated with each monitored object located at an identification gateway of a monitored environment, wherein said generating identification data is performed by an identification system;

generating tracking data associated with each monitored object located within said monitored environment, wherein said generating tracking data is performed by a tracking system;

merging and storing said identification data and said tracking data of each monitored object to form monitoring data for each monitored object; and comparing new content of said monitoring data of a monitored object with prior content of said monitoring data of said monitored object.

18. The method as recited in claim 17 further comprising:

processing said monitoring data.

19. The method as recited in claim 18 wherein said processing further includes:

generating a message based on a result of said comparison of said new and said prior content.

20. The method as recited in claim 18 wherein if said tracking system loses track of a first monitored object within said monitored environment, said processing includes:

determining whether a second monitored object represents said first monitored object lost by said tracking system.

21. The method as recited in claim 20 wherein said determining is performed in response to said identification system identifying said first monitored object after said tracking system lost track of said first monitored object, and wherein said processing further includes modifying said monitoring data based on said determining step.

22. The method as recited in claim 18 wherein if said tracking system tracks a plurality of monitored objects within said monitored environment and if said tracking system reduces certainty related to correct association between tracking data and said monitored objects, said processing includes:

increasing said certainty in response to said identification system identifying at least one of said monitored objects after said tacking system reduced said certainty.

23. The method as recited in claim 22 wherein said processing further includes modifying said monitoring data upon increasing said certainty.

24. A computer-readable medium comprising computer-executable instructions stored therein for performing a method of monitoring an object, said method comprising:

generating identification data associated with each monitored object located at an identification gateway of a monitored environment, wherein said generating identification data is performed by an identification system;

generating tracking data associated with each monitored object located within said monitored environment, wherein said generating tracking data is performed by a tracking system;

merging and storing said identification data and said tracking data of each monitored object to form monitoring data for each monitored object; and comparing new content of said monitoring data of a monitored object with prior content of said monitoring data of said monitored object.

25. The computer-readable medium as recited in claim 24 wherein said method further comprises:

processing said monitoring data.

26. The computer-readable medium as recited in claim 25 wherein said processing further includes:

generating a message based on a result of said comparison of said new and said prior content.

27. The computer-readable medium as recited in claim 25 wherein if said tracking system loses track of a first monitored object within said monitored environment, said processing includes:

determining whether a second monitored object represents said first monitored object lost by said tracking system.

28. The computer-readable medium as recited in claim 27 wherein said determining is performed in response to said identification system identifying said first monitored object after said tracking system lost track of said first monitored object, and wherein said processing further includes modifying said monitoring data based on said determining step.

29. The computer-readable medium as recited in claim 25 wherein if said tracking system tracks a plurality of monitored objects within said monitored environment and if said tracking system reduces certainty related to correct association between tracking data and said monitored objects, said processing includes:

increasing said certainty in response to said identification system identifying at least one of said monitored objects after said tracking system reduced said certainty.

30. The computer-readable medium as recited in claim 29 wherein said processing further includes modifying said monitoring data upon increasing said certainty.

* * * * *

UNITED STATES PATENT AND TRADEMARK OFFICE

CERTIFICATE OF CORRECTION

PATENT NO. : 7,057,509 B2
APPLICATION NO. : 10/881975
DATED : June 6, 2006
INVENTOR(S) : Giovanni Gualdi et al.

It is certified that error appears in the above-identified patent and that said Letters Patent is hereby corrected as shown below:

In column 15, line 59, in Claim 14, delete "compnsing:" and insert -- comprising: --, therefor.

In column 16, line 57, in Claim 22, delete "tacking" and insert -- tracking --, therefor.

Signed and Sealed this

Nineteenth Day of January, 2010

David J. Kappos

David J. Kappos
*Director of the United States Patent and Trademark Office*